US005089689A

United States Patent [19]

Kidder et al.

[11] Patent Number: 5,089,689

[45] Date of Patent: Feb. 18, 1992

[54] FLAME SAFEGUARD CONTROL ANTI-SWAP FEATURE

[75] Inventors: Kenneth B. Kidder, Coon Rapids; Wilmer L. Adams, Fridley, both of Minn.

[73] Assignee: Honeywell Inc., Minneapolis, Minn.

[21] Appl. No.: 418,599

[22] Filed: Oct. 9, 1989

[51] Int. Cl.[5] ..... H05B 1/02

[52] U.S. Cl. ..... 219/506; 219/491; 219/494; 219/485; 361/1

[58] Field of Search ..... 219/491, 494, 497, 501, 219/506, 485; 361/59, 1

[56] References Cited

U.S. PATENT DOCUMENTS 4,356,370 10/1982 Horinouchi ..... 219/492
4,787,481 11/1988 Farrar et al. ..... 187/101
4,829,161 5/1989 Kadwell et al. ..... 219/494

*Primary Examiner*—Mark H. Paschall
*Attorney, Agent, or Firm*—Kinney & Lange

[57] ABSTRACT

An apparatus ensures that a controller memory is programmed to store safety critical information corresponding to a heating system in which it is installed. The heating system has a controller and a controller memory which controls the heating system based on input parameters provided to the controller and based on safety critical information stored in the controller memory. A program signal is generated when the controller memory is electrically disconnected from the heating system indicating that the controller memory must be programmed to include safety critical information. Operation of the heating system is inhibited in response to the program signal.

11 Claims, 2 Drawing Sheets

FLAME SAFEGUARD CONTROL ANTI-SWAP FEATURE

BACKGROUND OF THE INVENTION

1. Field of the Invention

This invention relates to controlling a heating system. More particularly, this invention relates to ensuring that controller memory is properly programmed with safety critical information corresponding to a heating system.

2. Description of the Prior Art

Traditionally, heating systems such as burners, ovens and furnaces have used electromechanical limit switches to monitor safety-related parameters such as pressures and temperatures. When the safety-related parameters reached limits, which were set in the electromechanical limit switches, the electromechanical limit switches would automatically open or close to control the heating system. Heating system operators could exchange or replace controllers in the heating system without affecting the limits since they were set in the electromechanical limit switches.

However, many heating system controllers are now microcomputer-based heating system controllers that interface with solid-state analog sensors. The solidstate analog sensors provide the microcomputer-based controller with a continuous signal representing the safety-related parameters such as pressures and temperatures. The limits, which were previously set at the electromechanical limit switches, are stored in memory in the microcomputer-based controller where their values can be modified by the heating system operator. Therefore, when a heating system operator exchanges or replaces a microcomputer-based controller, it has a much greater effect on system operation and safety than before.

For this reason, the heating system operator must re-enter limit and timing values that are proper for the heating system which is receiving the new controller. Some operators may choose to ignore the task of reprogramming the new controller or they may forget or be unaware of the need for reprogramming. This could lead to improper and possibly hazardous control of the heating system by the new controller.

SUMMARY OF THE INVENTION

The present invention ensures that a controller memory is programmed to store safety-critical information corresponding to a heating system in which it is installed. The heating system has a controller for controlling the heating system based on input parameters provided to the controller and based on safety-critical information stored in the controller memory. A program signal is generated when the controller memory is electrically disconnected from the heating system. When the controller memory is re-connected to a heating system, operation of the heating system is inhibited in response to the program signal.

DETAILED DESCRIPTION OF THE PREFERRED EMBODIMENTS

Figure 1:
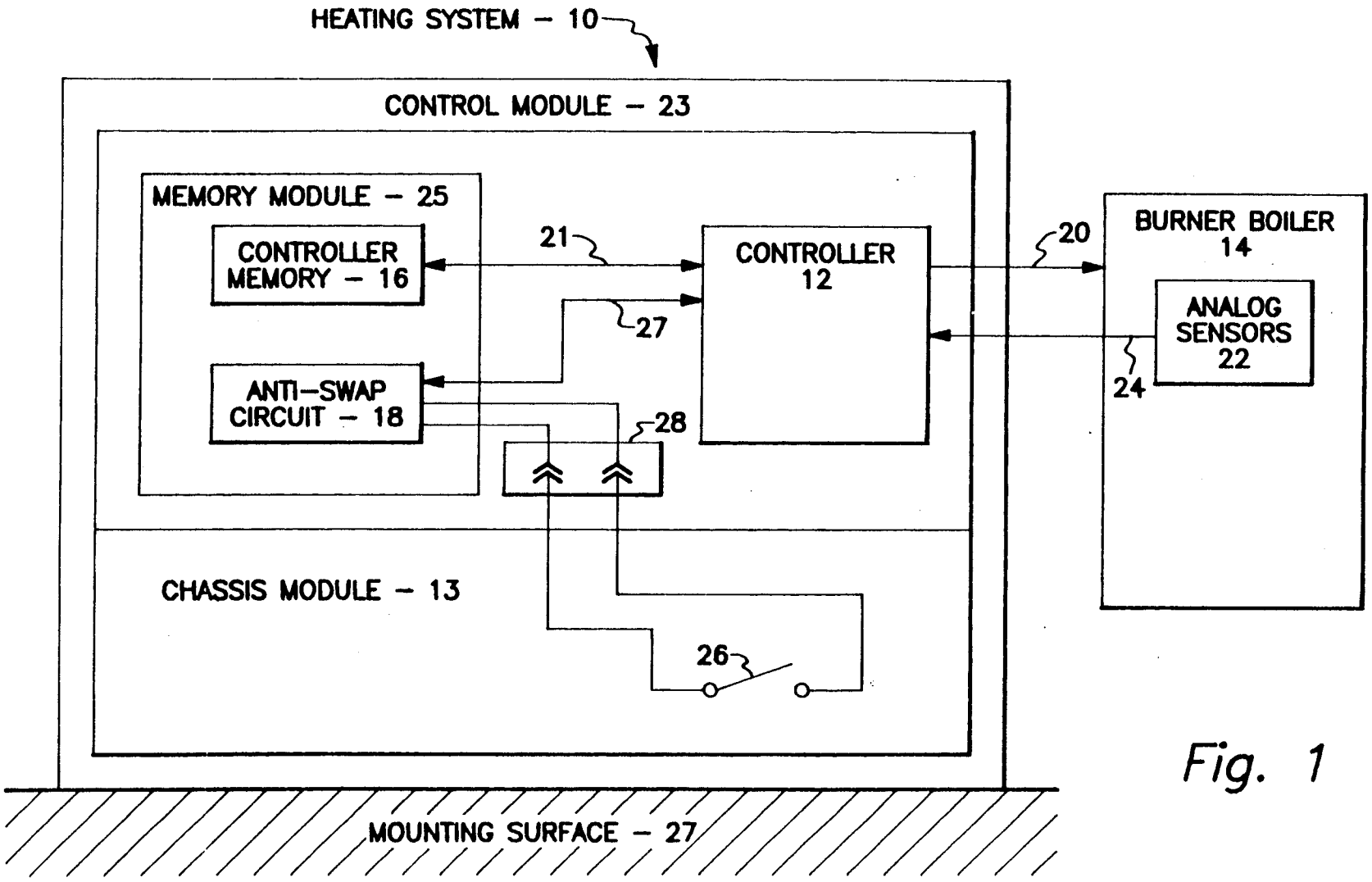
FIG. 1 is a block diagram of a heating system.

FIG. 1 is a block diagram of heating system 10 which comprises controller 12, chassis module 13, burner boiler 14, controller memory 16, and anti-swap circuit 18. Controller 12, operating in conjunction with controller memory 16 and anti-swap circuit 18, commands outputs which control the operation of burner boiler 14. This is indicated by arrows 20, 21 and 27. Various parameters such as fuel pressure, steam pressure and fuel temperature are sensed at burner boiler 14 using analog sensors 22 which provide a continuous signal to controller 12 representing the sensed parameters. This is shown by arrow 24. Controller 12 compares the signals received from analog sensors 22 to various limits stored in controller memory 16. Based on that comparison, controller 12 determines whether any of the parameters sensed by analog sensors 22 are out of limits and controls operation of burner boiler 14 accordingly.

In heating system 10, controller 12, chassis module 13, controller memory 16 and anti-swap circuit 18 may comprise a control module 23 which is a single modular unit capable of being disconnected from mounting surface 27 in heating systems 10. Alternatively, controller memory 16 and anti-swap circuit 18 may comprise a memory module 25 which is a single modular unit capable of being disconnected from controller 12 and heating system 10. In either case, the modular units can either be replaced or exchanged with modular units from other heating systems. When this occurs, controller memory 16, whether it is a part of a control module or a memory module, must be reprogrammed by a heating system operator so that it contains the proper safety related information (such as the limits which are compared with the signals fed back to controller 12 by analog sensors 22, or various timing values) which corresponds to the heating system in which it is installed. These values may vary depending on the particular burner or boiler used in the heating system and the load being controlled.

Therefore, when either the control module 23 or the memory module 25 are electrically disconnected from heating system 10, anti-swap circuit 18 provides a program signal to controller 12. The program signal is generated when a series circuit connected to anti-swap circuit 18 is broken. The series circuit includes connector 28, if heating system 10 is configured with a memory module 25, and chassis module switch 26. If memory module 25 is removed from heating system 10, the series circuit is broken when the connection at connector 28 is broken. If control module 23 is removed from mounting surface 27, the removal is detected by switch 26 which opens upon removal of control module 23 breaking the series circuit to anti-swap circuit 18. In response to the program signal, controller 12 inhibits operation of burner boiler 14 until a heating system operator has reprogrammed controller memory 16 with the proper safety related information.

Once the heating system operator has reprogrammed controller memory 16, controller 12 resets anti-swap circuit 18 and commences operation of burner boiler 14. The connections required for the interplay between anti-swap circuit 18 and controller 12 are indicated by arrow 27.

Figure 2:
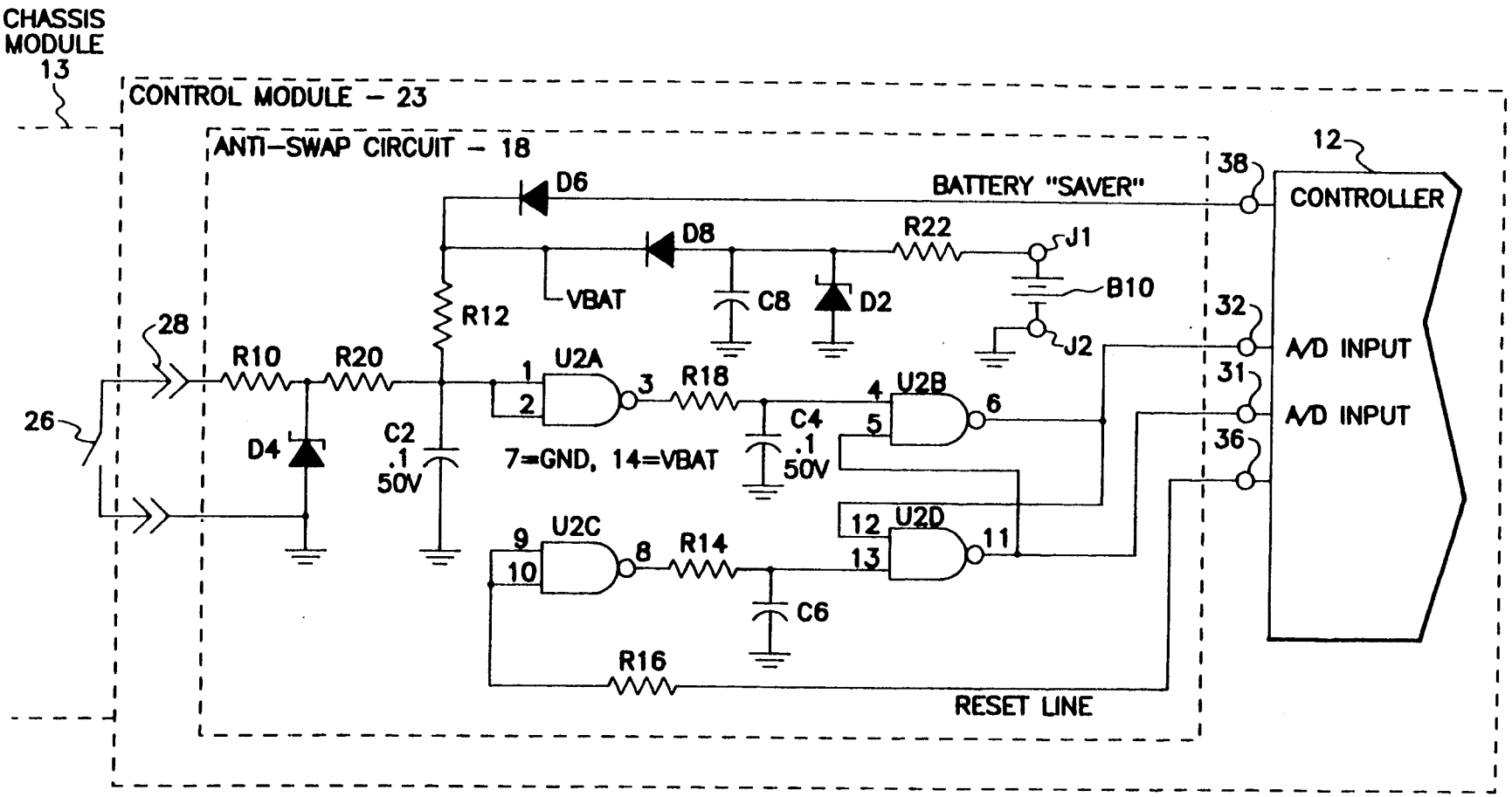
FIG. 2 is a schematic diagram of the anti-swap circuit of the present invention.

FIG. 2 is a schematic diagram of a portion of control module 23 and chassis module 13, including anti-swap circuit 18 of the present inVention connected to a portion of controller 12. Anti-swap circuit 18 comprises resistors R10, R12, R14, R16, R18, R20 and R22; diodes D2, D4, D6 and D8; capacitors C2, C4, C6 and C8; and NAND gates U2A, U2B, U2C, and U2D; also, battery B10 (which is nominally three volts) is coupled to nodes J1 and J2.

Anti-swap circuit 18 functions as a bi-stable flip-flop whose output state is changed either by controller 12 issuing a reset command or by the removal of the control module 23 or the memory module 25 (whichever heating system 10 is configured for). The series circuit to ground comprising switch 26 and connector 28 is broken when either switch 26 or connector 28 opens. Switch 26 detects whether a control module is removed from its mounting surface in heating system 10. If it is removed, switch 26 opens breaking the series circuit to ground.

Connector 28 is present if heating system 10 is configured with a memory module. When the memory module is removed, connector 28 opens.

When either switch 26 or connector 28 has opened, that means that either the control module has been removed and is to be replaced with another control module 23 or the memory module 25 has been removed. In either case, controller memory !6 in the module which was removed must be reprogrammed with safety critical information corresponding to the heating system in which it is subsequently installed.

When the control module or the memory module is removed from heating system 10, battery B10 powers anti-swap circuit 18 and either switch 26 or connector 28 breaks the series circuit to anti-swap circuit 18. In other words, the input to the bi-stable flip-flop is no longer tied to ground. This causes the output state of the bi-stable flip-flop to change. Therefore, when the module which was removed is re-installed in a heating system, the bi-stable flip-flop in anti-swap circuit 18 signals controller 12, at A/D input nodes 32 and 34, that controller memory 16 must be reprogrammed with the necessary safety critical information. Until controller memory 16 is reprogrammed, controller 12 inhibits operation of burner boiler 14.

When reprogramming is completed, controller 12 issues a reset command to anti-swap circuit 18 on logic output 36 which resets the bi-stable flip-flop in anti-swap circuit 18. This enables controller 12 to initiate operation of burner boiler 14.

If controller memory 16 is properly reprogrammed and if battery B10 is removed or allowed to discharge, heating system 10 continues to operate without reprogramming until power is removed from anti-swap circuit 18. Then, because battery B10 no longer powers anti-swap circuit 18, the output state of the bi-stable flip-flop changes and reprogramming is required.

The technique of using dual outputs form anti swap circuit 18, battery saver logic output 38 from controller 12, as well as A/D inputs 32 and 34 to controller 12, provides a mechanism which improves retention of charge in battery B10 and allows battery B10 to be tested to determine whether it is properly charged. When power is applied to controller 12, controller 12 provides a battery saver signal which is a logic high output at battery saver logic output 38. The battery saver signal causes diode D6 to be forward biased and diode D8 to be reverse biased effectively switching battery B10 out of anti-swap circuit 18. This helps battery B10 to retain its charge.

When the battery saver signal is switched by controller 12 to a logic low, diode D6 becomes reverse biased and diode D8 becomes forward biased. In this case, battery B10 powers the bi-stable flip-flop in anti-swap circuit 18. During this time, an analog-to-digital (A/D) converter in controller 12 converts the signals appearing at dual A/D input nodes 32 and 34 into digital signals. These digital signals, when they are supposed to be logic high, are compared with a minimum value stored in controller memory 16. When the digital signals are below the stored minimum value, a replace battery warning is issued by controller 12 to alert the heating system operator that anti-swap circuit 18 requires a new battery. If the heating system operator replaces the battery before the next time power is removed from controller 12, reprogramming will not be required.

It should be noted that, in this preferred embodiment, whether heating system 10 is configured with a memory module or a control module, anti-swap circuit 18 is included. Therefore, anti-swap circuit 18 stays with any module which is removed from heating system 10 and which, consequently, needs to be reprogrammed wherever it is reinstalled.

CONCLUSION

This invention ensures that controller 12 in heating system 10 will not initiate operation of heating system 10 until controller memory 16 in heating system 10 has been programmed with safety critical information corresponding to heating system 10 in which it is installed.

Additionally, the present invention provides battery saver features which enables anti-swap circuit 18 of the present invention to retain battery charge and be tested for a discharged or removed battery.

Although the present invention has been described with reference to preferred embodiments, workers skilled in the art will recognized that changes may be made in form and detail without departing from the spirit and scope of the invention.

What is claimed:

1. For use in a heating system having a controller and a controller memory for controlling the heating system based on input parameters provided to the controller and based on safety critical information stored in the controller memory, an apparatus for ensuring that the controller memory is programmed to store safety critical information corresponding to the heating system in which it is installed comprising:

program signal generating means for generating a program signal when the controller memory is electrically disconnected from the heating system, the program signal indicating that the controller memory must be programmed to include safety critical information corresponding to the heating system in which the controller memory is subsequently installed; and inhibiting means for inhibiting, in response to the program signal, operation of the heating system in which the controller memory is subsequently installed.

2. The apparatus of claim 1 and further comprising:

clearing means for clearing the program signal after the controller memory is reprogrammed to contain the safety critical information corresponding to the heating system in which the controller memory is installed.

3. The apparatus of claim 1 wherein the program signal generating means is fixably attached to the controller memory to ensure that the controller memory is reprogrammed upon being installed in a heating system.

4. The apparatus of claim 2 wherein the controller comprises the inhibiting means and the clearing means.

5. The apparatus of claim 4 wherein the program signal generating means further comprises:

bi-stable flip-flop means having an input, a clear input and output means, the clear input and the output means being coupled to the controller when the controller memory is installed in the heating system and where the output means change state when the controller memory is disconnected from the heating system.

6. The apparatus of claim 5 wherein the input of the bi-stable flip-flop means comprises :

a series connected circuit which is broken when the controller memory is disconnected from the heating system causing the output means of the bi-stable flip-flop means to change states.

7. The apparatus of claim 6 wherein the controller inhibits operation of the heating system until the controller memory is programmed with the safety critical information corresponding to the heating system in response to the program signal appearing at the output means of the bi-stable flip-flop means and wherein the controller clears the program signal by providing a clear signal to the clear input of the bi-stable flip-flop means.

8. The apparatus of claim 7 wherein the safety critical information comprises :

limit information corresponding to the heating system.

9. The apparatus of claim 4 wherein the bi-stable flip-flop means further comprises :

battery means for powering the bi-stable flip flop means when other power sources are removed.

10. The apparatus of claim 9 wherein the battery means is selected or deselected by the controller means where the controller means powers the bi-stable flip-flop means when the battery means is deselected to retain charge in the battery means.

11. The apparatus of claim 10 wherein the output means of the bi-stable flip-flop means are coupled to signal comparing means, for comparing signal levels appearing at the output means to expected levels, to test the battery means.

* * * * *